US005970656A

United States Patent [19]

Maier

[11] Patent Number: 5,970,656

[45] Date of Patent: Oct. 26, 1999

[54] HOUSING ASSEMBLY WITH BEVELED RETAINERS FOR INSTALLATION IN A WINDOW FRAME

[75] Inventor: Robert G. Maier, Hudson, Ohio

[73] Assignee: Ro-Mai Industries, Inc., Twinsburg, Ohio

[21] Appl. No.: 09/152,458

[22] Filed: Sep. 14, 1998

[51] Int. Cl.[6] ..... E05D 15/22

[52] U.S. Cl. ..... 49/181; 49/446

[58] Field of Search ..... 49/181, 180, 182, 49/445, 446, 185

[56] References Cited

U.S. PATENT DOCUMENTS

| | | | |
|---|---|---|---|
| 4,167,835 | 9/1979 | Nobes et al. . | |
| 4,320,597 | 3/1982 | Sterner, Jr. . | |
| 4,400,026 | 8/1983 | Brown, Jr. . | |
| 4,475,311 | 10/1984 | Gibson . | |
| 4,553,353 | 11/1985 | Simpson . | |
| 4,578,903 | 4/1986 | Simpson . | |
| 4,622,778 | 11/1986 | Simpson . | |
| 4,624,073 | 11/1986 | Randall . | |
| 4,640,048 | 2/1987 | Winner et al. . | |
| 4,669,765 | 6/1987 | Ullman . | |
| 4,790,579 | 12/1988 | Maxwell et al. . | |
| 4,791,756 | 12/1988 | Simpson . | |
| 4,837,975 | 6/1989 | Simpson . | |
| 4,869,020 | 9/1989 | Andres . | |
| 4,901,475 | 2/1990 | Simpson . | |
| 4,955,159 | 9/1990 | Rogers . | |
| 4,961,286 | 10/1990 | Bezubic . | |
| 5,014,466 | 5/1991 | Winner . | |
| 5,028,083 | 7/1991 | Mischenko . | |
| 5,096,240 | 3/1992 | Schultz . | |
| 5,127,685 | 7/1992 | Dallaire et al. . | |
| 5,139,291 | 8/1992 | Schultz . | |
| 5,165,737 | 11/1992 | Riegelman . | |
| 5,301,989 | 4/1994 | Dallmann et al. . | |
| 5,669,180 | 9/1997 | Maier | 49/181 |
| 5,704,165 | 1/1998 | Slocomb et al. | 49/181 |
| 5,829,196 | 11/1998 | Maier | 49/181 |

*Primary Examiner*—Daniel P. Stodola
*Assistant Examiner*—Curtis A. Cohen
*Attorney, Agent, or Firm*—Pearne, Gordon, McCoy & Granger LLP

[57] ABSTRACT

Plural retainers are provided along each side of a tilt latch or pivot housing. The retainers each form an engagement surface that engages an edge of a notch in a window sash. The tilt latch retainers are flared upwardly and beveled rearwardly to facilitate installation longitudinally or vertically. The pivot retainers are flared downwardly and beveled rearwardly to facilitate installation longitudinally or vertically.

22 Claims, 4 Drawing Sheets

HOUSING ASSEMBLY WITH BEVELED RETAINERS FOR INSTALLATION IN A WINDOW FRAME

BACKGROUND OF THE INVENTION

This invention relates generally to the field of window hardware and specifically to a tilt latch or pivot housing.

Double hung windows are provided with counterbalances for maintaining a sash in an elevated position. Springs or weights connected to the sash act as the counterbalance. Many window sashes are adapted for tilting inwardly for cleaning. The sash tilts on a pivot assembly at the bottom of the sash. Spring operated tilt latches at the top of the sash retain the sash in the vertical position and are released for pivoting of the sash. Latches, generally tilt latches, are shown, for example, in U.S. Pat. No. 4,837,975 to Simpson, U.S. Pat. No. 4,901,475 to Simpson, U.S. Pat. No. 4,167,835 to Nobes, U.S. Pat. No. 4,578,903 to Simpson, U.S. Pat. No. 4,475,311 to Gibson, U.S. Pat. No. 4,955,159 to Rogers, U.S. Pat. No. 4,869,020 to Andres, U.S. Pat. No. 4,961,286 to Bezubic, U.S. Pat. No. 4,790,579 to Maxwell, U.S. Pat. No. 4,553,353 to Simpson, U.S. Pat. No. 4,400,026 to Brown, U.S. Pat. No. 4,791,756 to Simpson, U.S. Pat. No. 4,320,597 to sterner, U.S. Pat. No. 4,640,048 to Winner, U.S. Pat. No. 4,622,778 to Simpson, U.S. Pat. No. 4,624,073 to Randall, U.S. Pat. 4,669,765 to Ullman, U.S. Pat. No. 5,301,989 to Dallmann, U.S. Pat. No. 5,028,083 to Mischenko, U.S. Pat. No. 5,096,240 to Schultz, U.S. Pat. No. 5,127,685 to Dallaire, U.S. Pat. No. 5,165,737 to Riegelman, U.S. Pat. No. 5,014,466 to Winner, and U.S. Pat. No. 5,139,291 to Schultz, all of which are incorporated herein by reference.

FIGS. 10 and 11 show a prior art tilt latch housing. A housing 250 includes a bottom wall 254, side walls 256, a rear wall 258, and a top wall 260 defining a hollow cavity 262 opening at a front end of the housing. The top wall 260 defines a flange 264 at the top of the side and rear walls 256, 258. Retainers 261 project from the side walls 256 and rear wall 258. Each retainer is flared, that is, the retainer slopes outwardly from the wall to a lip 269 that defines a catch for engaging edges of a notch in a header rail of a sash. The space between the lip 269 and flange 264 defines a gap or short groove 263 for receiving an edge of the sash therein. A bottom retainer 270 projects downwardly from the bottom wall 254 near the front end of the housing 250.

BRIEF SUMMARY OF THE INVENTION

The present invention provides a housing for installation in a window frame having a window sash with a notch defining a pair of opposed edges. The housing includes side walls, a rear wall, and a top wall extending beyond the side walls and rear wall to define a flange. A retainer, such as a protuberance, projects from each of the side walls. Each retainer has a retaining surface spaced from the flange for receiving one of the opposed edges therebetween. The retainer is beveled to define a rearward camming surface.

Preferably, the side walls are provided with plural retainers for receiving one of the opposed edges between the retainer and the flange and each being beveled. A rear protuberance projects from the rear wall and is spaced from the flange to define a gap for receiving the rear edge of the notch. The housing also includes a bottom wall and a retainer projecting from the bottom wall near a front edge of the bottom wall. A pivot bar or movable bolt projects from the housing.

The invention also includes a window sash assembly. A sash has a header rail and a stile joined at a corner and having an opening in the sash. A tilt latch disposed in the opening includes a housing having side walls, a rear wall, and a bottom wall. A top wall extends beyond the side walls and rear wall to define a flange. A retainer projects from each of the side walls, each retainer having a retaining surface spaced from the flange for receiving one of the edges therein. A bolt is movably disposed in the housing and adapted for engaging a slide channel. Each retainer is beveled to define a rearward camming surface.

DESCRIPTION OF THE INVENTION

Figure 1:
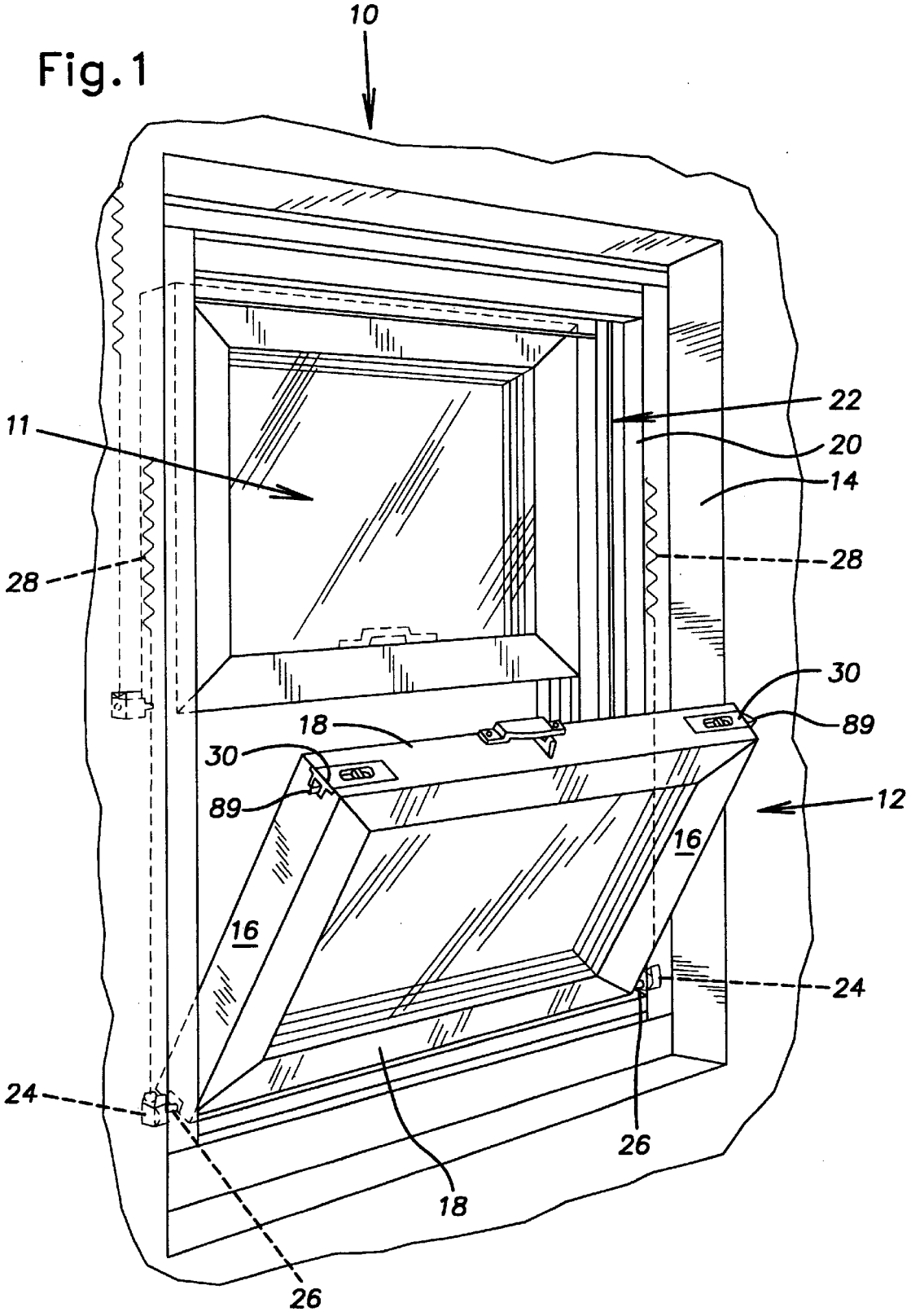
FIG. 1 shows a perspective view of a double hung window according to the invention.

Referring to FIG. 1, a double hung window assembly 10 includes an upper sash 11 and a lower sash 12 that are slidable in a window frame 14. The lower sash 12, for example, includes vertically disposed stiles 16 and horizontally disposed rails 18 including an upper, header rail and a lower, footer rail. The window frame includes vertical jambs 20 defining opposed vertical slide channels 22 or tracks. Brake assemblies 24 are slidable in respective slide channels 22. Lower corners of the sash 12 are provided with pivot assemblies 26 that are associated with respective brake assemblies 24 to define pivot and brake assemblies. The brake assemblies 24 are supported by respective counterbalances, such as balance springs 28 disposed in the slide channels 22. Tilt latches 30 are disposed in upper corners of the sash 12 for releasably retaining the upper end of the sash in the slide channels 22.

Figure 2:
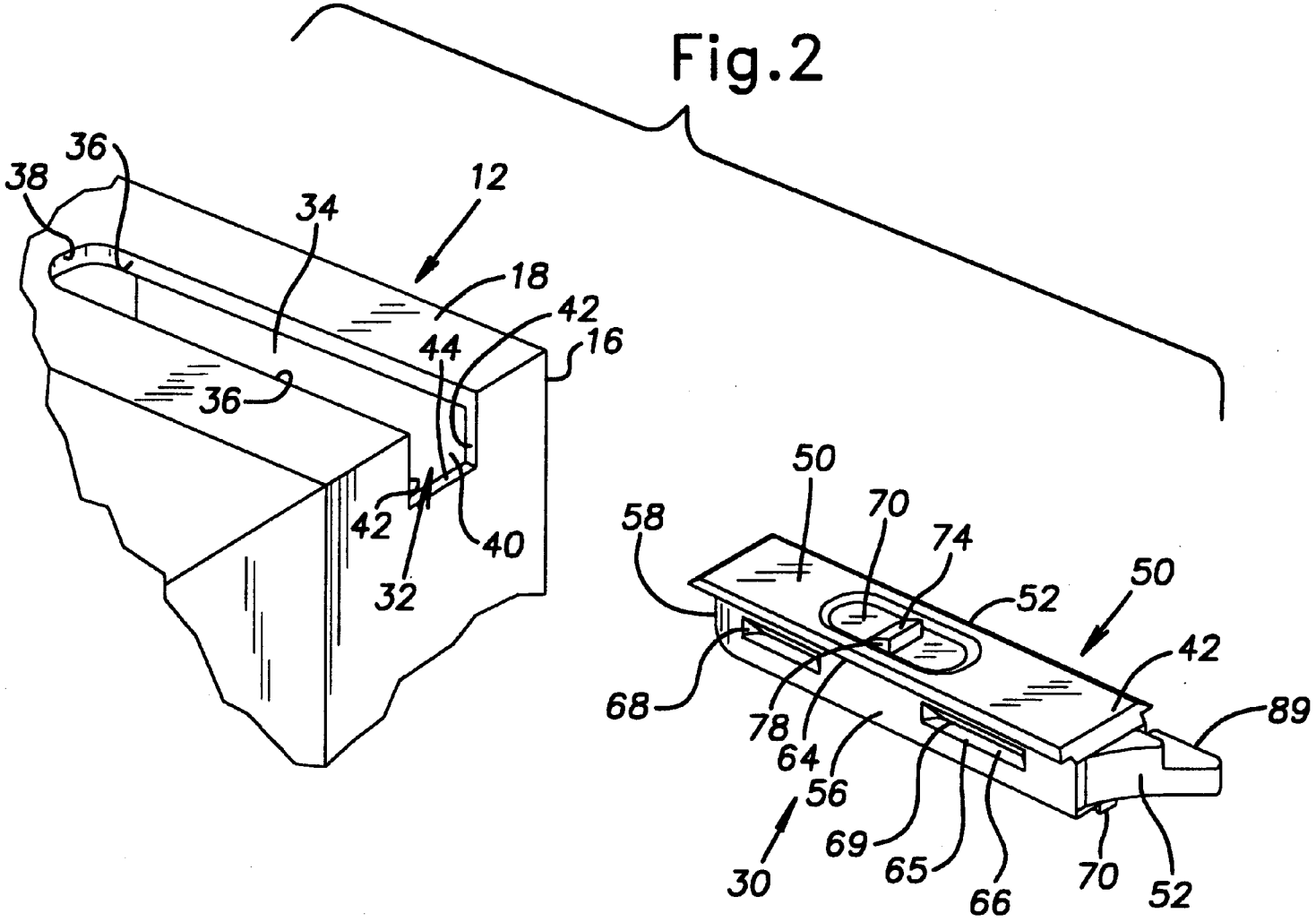
FIG. 2 shows a perspective view of a tilt latch and part of a sash of the window.

Referring to FIG. 2, an opening 32 is cut in the sash 12 for receiving the tilt latch 30 therein. The opening 32 includes a slot 34 in the header rail 18 defined by opposed edges 36 blending into a U-shaped rear edge 38. The opening also includes a slot 40 in the stile 16 defined by opposed edges 42 and a bottom edge 44. The edges 36 of the header slot 34 meet the edges 42 of the stile slot 40 so that the opening 32 is continuous.

The tilt latch 30 includes a housing 50 and a movable bolt 52 projecting therefrom. The housing 50 is sized to fit in the opening 32 so that the bolt 52 extends outwardly from the stile 16.

Figure 3:
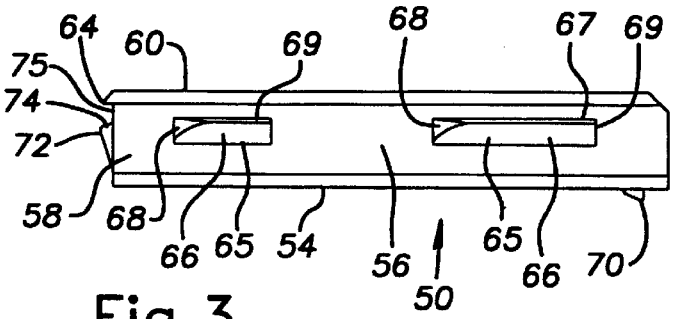
FIG. 3 shows a side elevational view of the tilt latch.
Figure 4:
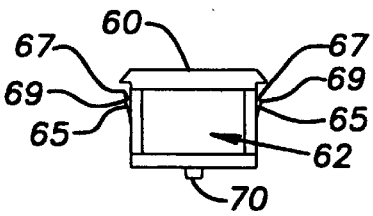
FIG. 4 shows an end view of the latch.

Referring to FIGS. 3 and 4, the housing 50 includes a bottom wall 54, side walls 56, a rear wall 58, and a top wall 60 defining a hollow cavity 62 opening at a front end of the housing. The top wall 60 defines a flange 64 at the top of the side and rear walls 56, 58. A plurality of retainers 65 are provided at the side walls. The retainers 65 are beveled in two directions. Each retainer is vertically flared, that is, the retainer slopes outwardly in an upward direction and intersects an engagement surface 67 to define a lip 69 spaced from the flange 64. The engagement surface 67 is generally perpendicular to the side wall 56, but preferably slopes slightly downwardly. Preferably, the upward slope defines an arcuate vertical camming surface 66 having an increasing slope. Each retainer also slopes outwardly in a forward direction to define a rearward camming surface 68 from the side wall 56 to a point on the lip 69. The number and spacing of the retainers 65 depend on the dimensions of the window sash and housing. One or more protuberances 72 or rear flanges project from the rear wall 58 and have a lip 74 or face spaced from the flange 64 to define a gap 75.

Figure 5:
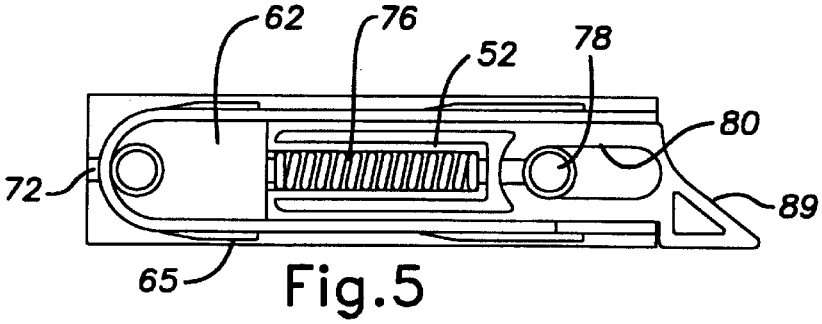
FIG. 5 shows a bottom view of the latch with the bottom cover removed.
Figure 6:
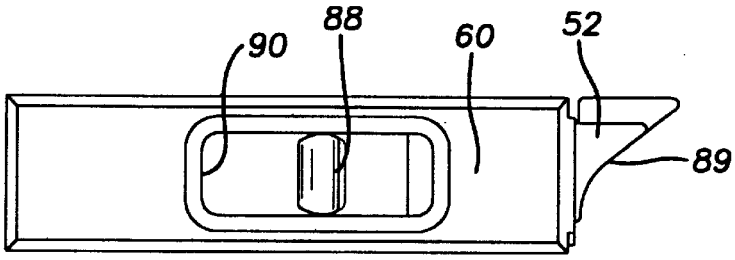
FIG. 6 shows a top view of the latch.

Referring to FIGS. 5 and 6, the bolt 52 is slidably disposed in the cavity 62 of the housing. A spring 76 biases the bolt 52 forwardly to an extended position. A post 78 extends between the top and bottom walls 60, 54 through a slot 80 of the bolt 52 and limits forward travel of the bolt. The post 78 can provide for securing upper and lower components of the housing. When the housing is a single piece, the post can be omitted. A knob 88 provided on the top surface of the bolt 52 projects through a slot 90 in the top wall 60 of the housing. A nose 89 of the bolt is adapted for engaging in the slide channel 22 (FIG. 1) for retaining the sash in the window frame. The sash is releasable by use of the knob 88 to retract the bolt 52 thereby disengaging the nose 89 from the channel 22.

Referring to FIG. 2, the tilt latch 30 is installed in the sash 12. The rear end of the housing 50 is placed adjacent the opening 32 in the stile 16. The housing 50 is moved longitudinally so that the rearward camming surfaces 68 of the rear retainers 65 spread the edges 42 and/or force the retainers 65 inwardly by flexing the side walls 56, thus allowing the retainer to pass through the slot 40. The edges 36 of the slot 34 are received between the retainers 65 and the flange 64 near the rear end of the housing. As the housing 50 is moved longitudinally, the front retainers 65 pass through the slot similarly to the rear retainers and the edges are received between the retainers 65 and the flange 64 until the rear wall 58 engages the rear edge 38 and the retainer 70 engages behind the wall of the stile 16 adjacent the bottom edge 44. The rear edge 38 is received in the rear gap 75. The retainers engage the edges 36 along portions of the length of the slot 34 providing a snug fit.

The tilt latch can also be installed according to an alternative installation method (not shown). The rear wall 58 of the housing 50 is placed against the rear edge 38 of the slot 34 so that the rear edge 38 is received in the rear gap 75. The front end of the housing 50, near the projecting nose 89, is then forced downwardly. The downward camming surfaces 66 spread the edges 36 and/or force the retainers 65 inwardly by flexing the side walls 56, thus allowing the retainers to pass through the slot 34. The retainers 65 move past the edges 36 so that the edges 36 are received between the retainers 65 and the flange 64. The retainers 65 engage the edges 36 along portions of the length of the slot 34 providing a snug fit. The retainer 70 engages behind the wall of the stile 16 adjacent the bottom edge 44.

Figure 7:
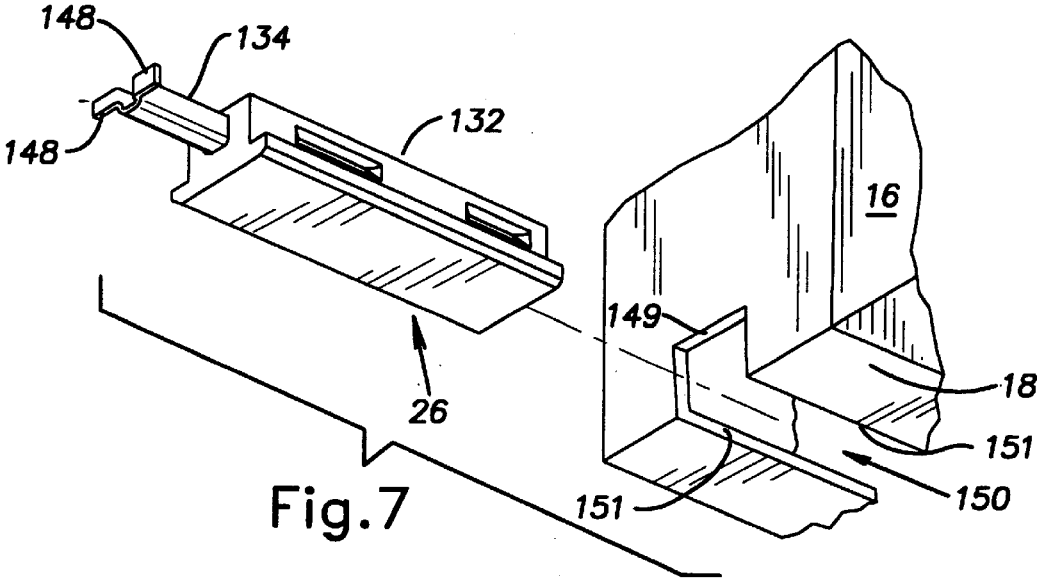
FIG. 7 shows a perspective view of a pivot assembly and part of the sash.
Figure 8:
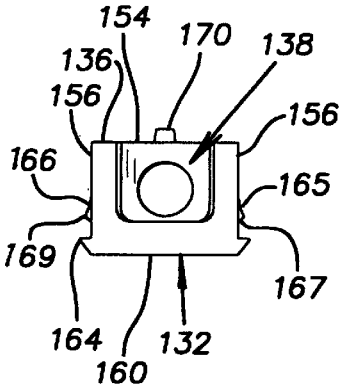
FIG. 8 shows an end view of the pivot assembly.
Figure 9:
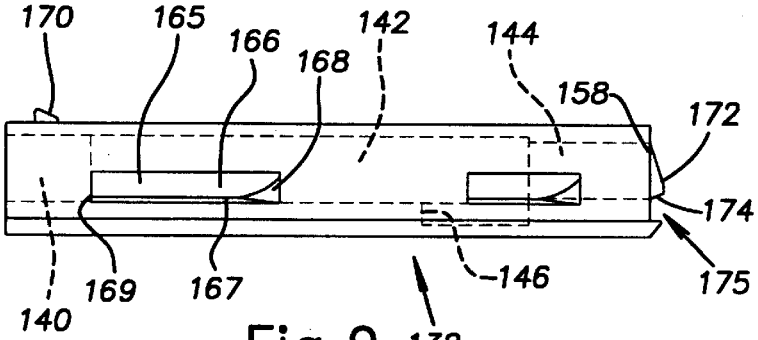
FIG. 9 shows a side view of the pivot assembly.
Figure 10:
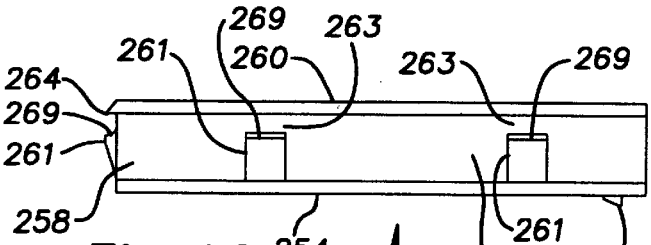
Fig.10 PRIOR ART
FIGS. 10 and 11 show a prior art tilt latch.
Figure 11:
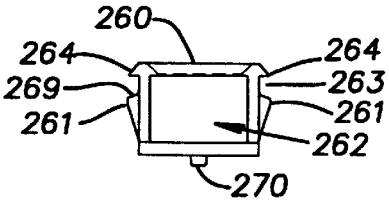
Fig.11 PRIOR ART

Referring to FIGS. 7, 8 and 9, the pivot assembly 26 includes a housing 132 with a pivot bar 134 located therein. The housing 132 includes a body 136 having a longitudinal bore 138. The bore 138 shown is generally rectangular, but other shapes are suitable as is apparent from the following description of the pivot bar 134. The bore 138 is stepped, that is, different parts of the bore have different cross-sectional dimensions and shapes. One end of the bore defines a mouth 140 slightly wider than the pivot bar 134 to facilitate installation and allow slight flexing thereof. A main part 142 of the bore is sized to snugly retain the pivot bar 134 therein. Another end of the bore is circular in cross section and defines a stop 144 against which the pivot bar 134 abuts. Adjacent the stop, a bottom wall is recessed to define a lip 146. The pivot bar 134 has a U-shaped cross section of formed metal. One end of the pivot bar is provided with laterally extending flanges 148. A detent (not shown) projects from a bottom wall of the pivot bar near another end. The pivot bar 134 is located within the bore 138 of the housing 132 so that the pivot bar detent engages behind the lip 146 to prevent longitudinal movement of the pivot bar in one direction. An end of the pivot bar 134 engages the stop 144 to prevent longitudinal movement of the pivot bar in another direction. The pivot bar projects from the housing 132 so that the flanges are spaced from the housing.

Referring to FIG. 7, the lower end of the sash stile 16 is provided with a notch 149 or slot to allow passage of the pivot housing 132 therethrough. A second notch 150 or slot is cut in a lower wall of the lower rail 18 to define a pair of opposed edges 151. The second notch 150 is as long as the housing 132.

Referring to FIGS. 8 and 9, the housing 132 includes a top wall 154, side walls 156, a rear wall 158, and a bottom wall 160. The bottom wall 160 defines a flange 164 at the bottom of the side and rear walls 156, 158. A plurality of retainers 165 are provided at the side walls. The retainers 165 are beveled in two directions. Each retainer slopes outwardly in a downward direction and intersects an engagement surface 167 to define a lip 169 spaced from the flange 164. The engagement surface 167 is generally perpendicular to the side wall 156, but preferably slopes slightly upwardly. Preferably, the downward slope defines an arcuate vertical camming surface 166 having an increasing slope. Each retainer also slopes outwardly in a forward direction to define a rearward camming surface 168 from the side wall 156 to a point on the lip 169. The number and spacing of the retainers 165 depend on the dimensions of the window sash and housing. One or more protuberances 172 or rear flanges project from the rear wall 158 and have a lip 174 or face spaced from the flange 164 to define a gap 175. A retainer 170 projects from the top of the body near one end. The pivot assembly 26 is installed similarly to the tilt latch as described above with reference to FIG. 2.

The present disclosure describes several embodiments of the invention, however, the invention is not limited to these embodiments. Other variations are contemplated to be within the spirit and scope of the invention and appended claims.

What is claimed is:

1. A housing for installation in a window frame having a window sash with a notch defining a pair of opposed edges, the housing comprising:

side walls each having rearward and forward ends;

a top wall extending beyond the side walls to define a flange extending along the side wall toward the rearward and forward ends of the side walls; and retainers at the side walls and spaced from the flange for receiving the edges therebetween, each retainer having a rearward end located toward the rearward end of the side wall, a forward end located toward the forward end of the side wall, and an outer side facing away from the side wall, wherein each retainer is beveled at its rearward end such that the rearward end of the retainer slopes outwardly in a direction toward the forward end of the retainer from the side wall to the outer side of the retainer to define a rearward camming surface.

2. A housing according to claim 1 wherein each retainer slopes outwardly from the side wall to define a vertical camming surface.

3. A housing according to claim 2 wherein the vertical camming surface is arcuate.

4. A housing according to claim 3 wherein the vertical camming surface has a non-constant slope.

5. A housing according to claim 1 wherein each retainer defines a lip spaced from and parallel to the flange for receiving one of the edges therebetween.

6. A housing according to claim 5 wherein the lip is spaced from the side wall by an engagement surface projecting from the side wall and spaced from the flange for engaging one of the edges.

7. A housing according to claim 1 wherein each retainer defines an engagement surface projecting from the side wall and spaced from the flange for engaging one of the edges.

8. A housing according to claim 1, further comprising a pivot bar projecting from the housing.

9. A housing according to claim 1, further comprising a movable bolt projecting from the housing.

10. A housing according to claim 1, wherein at least two of the retainers project from each of the side walls.

11. A housing for installation in a window frame having a window sash with a notch defining a pair of opposed edges, the housing comprising:

side walls each having rearward and forward ends;

a top wall extending beyond the side walls to define a flange extending along the side wall toward the rearward and forward ends of the side walls; and retainers at the side walls, each retainer having a lip and spaced from the flange for receiving the edges therebetween, each retainer having a rearward end located toward the rearward end of the side walls and a forward end located toward the forward end of the side walls, wherein each retainer is beveled at its rearward end such that the rearward end of the retainer slopes outwardly in a direction toward the forward end of the retainer from the side wall to the lip to define a rearward camming surface.

12. A housing according to claim 11 wherein the retainers project from the side walls.

13. A housing according to claim 11, wherein the housing is provided with plural retainers for receiving one of the edges between the retainer and the flange and each being beveled to define a rearward camming surface.

14. A housing retaining to claim 11, wherein each retainer is beveled to define a vertical camming surface.

15. A housing according to claim 11, further comprising a rear wall of the housing and a rear protuberance projecting from the rear wall and spaced from the flange to define a gap for receiving a rearward edge of the notch.

16. A housing according to claim 11 further comprising a bottom wall and a retainer projecting from the bottom wall near a front edge of the bottom wall.

17. A housing according to claim 11 wherein the lip is spaced from the side wall by an engagement surface projecting from the side wall and spaced from the flange for engaging one of the edges.

18. A housing according to claim 11, further comprising a pivot bar projecting from the housing.

19. A housing according to claim 11, further comprising a movable bolt projecting from the housing.

20. A housing according to claim 11, wherein at least two of the retainers project from each of the side walls.

21. A window sash assembly comprising:

a sash having a header rail and a stile joined at a corner and having an opening in the sash; and a tilt latch disposed in the opening including a housing having side walls each with rearward and forward ends, a rear wall, and a bottom wall; a top wall extending beyond the side walls and the rear wall to define a flange extending along the side wall toward the rearward and forward ends of the side walls; retainers projecting from the side walls, each retainer having an engagement surface spaced from the flange to define respective gaps for receiving one of the edges therebetween, each retainer having a rearward end located toward the rearward end of the side wall, a forward end located toward the forward end of the side wall and an outer side facing away from the side wall, wherein each retainer is flared to define a vertical camming surface and each retainer is beveled at its rearward end such that the rearward end of the retainer slopes outwardly in a direction toward the forward end of the retainer from the side wall to the outer side of the retainer to define a rearward camming surface; and a bolt movably disposed in the housing and adapted for engaging a slide channel.

22. A housing according to claim 21, wherein at least two of the retainers project from each of the side walls.

* * * * *

UNITED STATES PATENT AND TRADEMARK OFFICE

CERTIFICATE OF CORRECTION

PATENT NO. : 5,970,656

DATED : October 26, 1999

INVENTOR(S) : Robert G. Mzier

It is certified that error appears in the above-identified patent and that said Letters Patent is hereby corrected as shown below:

Col. 1, line 24, delete "sterner" and insert --Sterner--.

Col. 6, Claim 14, line 1, delete "retaining" and insert --according--.

Signed and Sealed this

Ninth Day of May, 2000

*Attest:*

Q. TODD DICKINSON

*Attesting Officer*

*Director of Patents and Trademarks*